US006681611B2

(12) United States Patent
Haag et al.

(10) Patent No.: US 6,681,611 B2
(45) **Date of Patent: *Jan. 27, 2004**

(54) PROCESS AND DEVICE FOR MANUFACTURING HOLES ON THE CIRCUMFERENCE OF HOLLOW SECTIONS

(75) Inventors: Ulrich Haag, Buxtehude (DE); Uwe Hardtke, Neu Wulmstorf (DE); Thomas Huelsberg, Rosengarten (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

This patent is subject to a terminal disclaimer.

(21) Appl. No.: 10/196,289

(22) Filed: Jul. 17, 2002

(65) Prior Publication Data

US 2002/0174698 A1 Nov. 28, 2002

Related U.S. Application Data

(62) Division of application No. 08/975,170, filed on Nov. 20, 1997, now Pat. No. 6,484,551.

(30) Foreign Application Priority Data

Nov. 20, 1996 (DE) ..... 196 47 963

(51) Int. Cl.[7] ..... B21D 26/02; B21D 28/18

(52) U.S. Cl. ..... 72/370.27; 72/55; 83/54; 83/108; 83/188

(58) Field of Search ..... 72/370.27, 55, 72/60, 61; 83/24, 25, 54, 98, 100, 108, 188

(56) References Cited

U.S. PATENT DOCUMENTS

| | | | | | |
|---|---|---|---|---|---|
| 2,341,187 | A | * | 2/1944 | Menger et al. | 83/98 X |
| 3,022,811 | A | * | 2/1962 | Huet | 83/188 X |
| 3,234,838 | A | * | 2/1966 | Faull | 83/54 X |
| 3,416,211 | A | * | 12/1968 | Ahlman | 83/54 X |
| 3,487,668 | A | * | 1/1970 | Fuchs, Jr. | 83/54 X |
| 3,489,045 | A | * | 1/1970 | Ray, Sr. | 83/188 |
| 3,495,486 | A | * | 2/1970 | Fuchs, Jr. | 72/55 X |
| 4,131,042 | A | * | 12/1978 | Rich et al. | 83/100 |
| 4,160,396 | A | * | 7/1979 | Matzner et al. | 83/100 |
| 4,930,384 | A | * | 6/1990 | Nakatsuji | 83/54 |
| 4,989,482 | A | * | 2/1991 | Mason | 72/55 X |
| 5,460,026 | A | * | 10/1995 | Schafer | 72/55 |
| 5,709,139 | A | * | 1/1998 | Shimizu et al. | 83/54 |
| 5,765,420 | A | * | 6/1998 | Schafer et al. | 72/55 |
| 5,799,524 | A | * | 9/1998 | Schafer et al. | 72/55 |
| 5,996,455 | A | * | 12/1999 | Haag et al. | 83/54 |
| 6,484,551 | B1 | * | 11/2002 | Hagg et al. | 72/370.27 |

FOREIGN PATENT DOCUMENTS

| | | |
|---|---|---|
| DE | 1 552 122 | 3/1971 |
| DE | 43 22 063 C1 | 8/1994 |
| DE | 195 06 067 C1 | 6/1996 |
| JP | 55-144334 | 11/1980 |

* cited by examiner

*Primary Examiner*—Charles Goodman
(74) *Attorney, Agent, or Firm*—Crowell & Moring LLP

(57) ABSTRACT

A process for manufacturing holes on the circumference of a hollow section situated in an internal high pressure forming tool uses the action of a punch integrated in the forming tool. A desired breaking point is formed on the hollow section, which follows the edge contour of the operating face of the punch; and after the withdrawal of the punch, the hollow section material surrounded by the desired breaking area, acted upon by internal high pressure, is extracted from the hollow section from the inside to the outside, forming a hole. In order to produce holes on the circumference of hollow sections, in which the shape of the outer circumference of the hollow section is maintained, the wall of the hollow section is weakened to form an unstable thin area. The punch penetrates into the wall of the hollow section at an internal high pressure which corresponds to the forming pressure for forming a hollow blank inserted in the forming tool. When the punch is withdrawn, the internal high pressure, tears the hollow section material surrounded by the thin area out of the hollow section in the withdrawal direction of the punch.

17 Claims, 4 Drawing Sheets

PROCESS AND DEVICE FOR MANUFACTURING HOLES ON THE CIRCUMFERENCE OF HOLLOW SECTIONS

This application is a Divisional application Ser. No. 08/975,170 filed on Nov. 20, 1997 now U.S. Pat. No. 6,484,551.

BACKGROUND AND SUMMARY OF THE INVENTION

This application claims the priority of German application number 196 47 963.0, the disclosure of which is expressly incorporated by reference herein.

The invention relates to a process and apparatus for making holes on the circumference of a hollow section situated in an internal high pressure forming tool.

A process and apparatus of this type are disclosed in German Patent Document DE 195 06 067 C1. There, the wall of a hollow section inserted into an internal high pressure forming tool is acted upon by a punch (which is integrated into the forming tool), from the outside against an internal pressure existing in the hollow section which is lower than the forming pressure customary for the forming of a hollow blank by means of internal high pressure forming. The plate-shaped plane punch penetrates into the wall of the hollow section, and the displaced flowable section material accumulates essentially uniformly on the interior of the hollow section. By means of the punch, an inward penetration or introverting of the hollow section is therefore achieved, whose edge is constructed of the stamping edge or the circumference of the punch. In this case, a cold solidification of the hollow section material takes place, after which, when the punch is withdrawn, the introverting is again pressed to the outside by the now rising internal pressure. The marginal, edge of the introverting formed on the punch side in this case forms a shearing edge of the hollow section material for the bottom of the introverting surrounded by it. As a result, at the site of the shearing edge, a surrounding desired breaking point is formed for the hollow section so that the separation of the mentioned bottom or of the later hole slug starts even before the actual cutting-out by means of the cutting edge constructed on the edge of the guide bore of the punch on the die. The cutting-out is therefore facilitated by the preceding separating operation at a defined point.

In the construction of the introverting and of the desired breaking point, the hollow section wall in the area of the future hole edge will be depressed into the interior by the action of the punch, because the internal high pressure is lower than a forming pressure. Although the introverting is pressed out to a certain degree by the rising internal pressure in the hollow section, major sink radii will remain after the generating of the hole which, in the case of different applications, are particularly undesirable, for example because of the lower distribution possibility of the Hertzian pressure and of the smaller support surface during the fastening of add-on parts on the hollow section.

To avoid such deformation on the exterior circumference of the section, a recalibration of the hollow section by means of a forming pressure would be required. Because of the separating operation which starts before the actual cutting-out and the subsequent final cutting-out, of the hole slug, a hole is, however, generated before the recalibrating, after which pressure between the hollow section interior and the space adjoining the hole is compensated outside the hollow section. A calibration of the hollow section is therefore no longer possible in the area of the hole, and the elimination of these radii cannot easily be achieved.

Furthermore, a high-expenditure pressure control is required in order to obtain a suitable process pressure in each phase of the separating process, because different pressure levels are provided for each phase. Also, for a final and clean cutting-out, the cutting edge on the tool die must be very precise and sharp, which in the manufacture of tools leads to significant expenditures. Moreover, the cutting edge will become dull after a certain operating time, because of the multiple action upon hollow sections during mass production. Thus, the sharpness of the cutting edge, on the one hand, must be examined in servicing intervals, and on the other hand, it must be reground if it has become unacceptably dull.

The servicing expenditures are considerable and high, in which case, the forming tool, which was produced at high cost itself, will become useless after some time because of an excessive wear as the result of abrasion. In this case, the hole diameter necessarily becomes larger, which is undesirable when narrow tolerances are indicated in the manufacturing and which considerably impairs the guiding of the acting punch. The latter results in a manufacturing of the desired breaking point which differs from one hollow section to the next, which has an unfavorable effect on the quality and the exact reproducibility of the hole production.

It is an object of the present invention to provide a process and apparatus of the above-mentioned type which can produce holes inside the internal high pressure forming tool on the circumference of hollow sections in a simple and reliable manner.

Another object of the invention is to provide a device with a high service life, which maintains the shaping of the outer circumference of the hollow section to be provided with a hole.

These and other objects and advantages are achieved by the method and apparatus according to the invention, in which a desired breaking point is created in the form of a thin area. The latter is dimensioned so that, when the punch is withdrawn, the hollow section material surrounded by the thin area (thus the hole slug) is torn out in a simple manner, driven by the internal high pressure corresponding to the forming pressure during the internal high pressure forming. The internal high pressure forming tool has no other part in the separating process of the hole slug, and is therefore protected from damage by the hollow section on the edge of the guide bore of the punch, so that the service life of the tool is not limited. At the same time, the reliability of the process is increased, because the guide bore of the punch is not subjected to wear on the marginal edge changing into the sinking; therefore no deviations occur during the construction of the desired breaking point. In this case, the production of the hole is almost without tolerances and can be reproduced with accurate dimensions. Only the punches are subjected to wear, which is nevertheless low because they must only penetrate into the hollow section, and not cut through it. In addition, the punch can be easily exchanged.

Because the hole producing operation according to the invention takes place at a uniform pressure level, only slight demands are made on the pressure control. The height of the pressure level corresponds to the internal high pressure forming pressure during the profiling of a hollow blank or during the calibrating of the hollow section. As a result, the hollow section material around the edge of the hole to be produced is always pressed against the wall of the sinking even during the penetration by the punch so that sink radii produced by the denting-in of the hollow section wall are avoided and thus the outer shape of the hollow section is maintained.

Other objects, advantages and novel features of the present invention will become apparent from the following detailed description of the invention when considered in conjunction with the accompanying drawings.

DETAILED DESCRIPTION OF THE DRAWINGS

Figure 1:
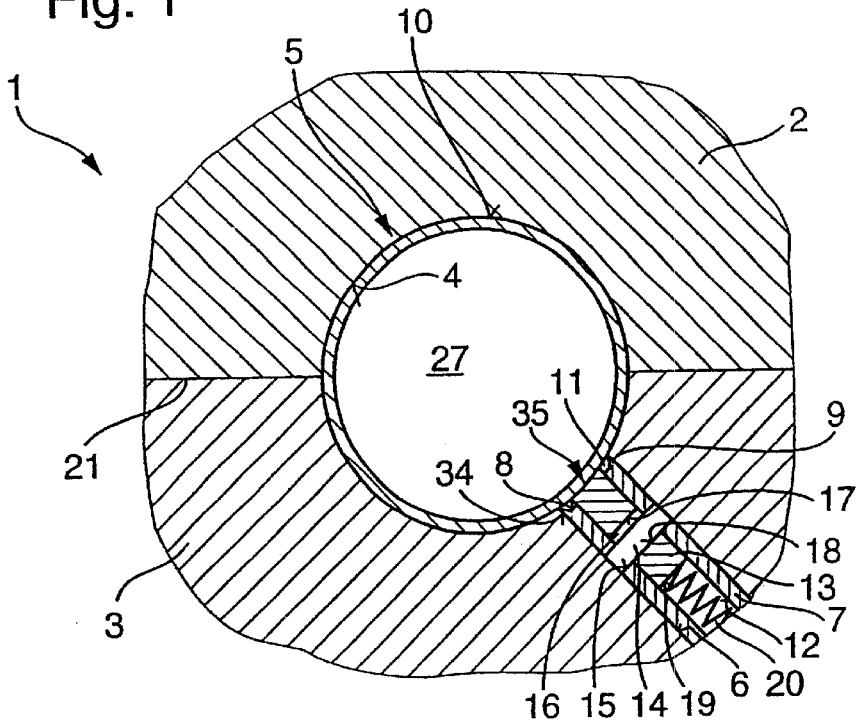
FIG. 1 is cross-sectional view of the device according to the invention having a hollow section inserted in the sinking of the internal high pressure forming tool and having a punch provided with a ring blade, in the inoperative position of the punch in the pressureless condition of the tool before the machining of the hollow section.

FIG. 1 illustrates a two-part internal high pressure forming tool 1 which consists of a top tool 2 and a bottom tool 3 which form the two halves of the tool 1. The area of division 21 of the top tool and the bottom tool 2, 3 is horizontally aligned. In the sinking 4 formed by the upper and the lower tool 2, 3, a pipe-shaped hollow section 5 is inserted which has a circular cross-section. However, in this case, other cross-sectional geometries of the hollow section 5 and corresponding shapes of the sinking 4 are also conceivable. The hollow section may also be bent once or several times along its length.

At an angle of approximately 45° with respect to the hollow section axis, a precisely machined guide bore 6 is worked into the bottom tool 3 and is aligned radially with respect to the sinking 4 and leads out into this sinking 4. A cutting punch 7 is displaceably guided in the guide bore 6. The cutting punch 7 rests with only little play on the wall of the guide bore 6, in which case it and/or the punch circumference, for reducing wear and for reduction friction of the two friction partners punch 7 and guide bore wall, may be provided with a wear protection layer which increases the sliding characteristics of the punch 7 in the guide bore 6. The guide bore 6 may also be situated at different angles and must not necessarily be radially aligned. However, the radial alignment is advantageous for a simple construction of the punch 7 in the case of a pipe-shaped hollow section 5.

The punch 7 is constructed to be cylindrical with a circular cross-section. On its face 8 facing the sinking 4, the punch 7 has a ring blade 9 which is aligned with its outer side 34 with the circumference of the punch 7, which ring blade 9, in the inoperative position of the punch 7 illustrated in FIG. 1, rests continuously on the exterior side 10 of the hollow section 5 and in the process closes off flush with the sinking 4 in a surrounding manner. The ring blade 9 bounds a trough 11 whose base is formed by the face 8. The trough 11 and simultaneously also the face 8 are shaped such that the wall piece of the hollow section 5 which is later acted upon by the punch 7 can be accommodated almost completely.

The punch 7 has an axial bore 12 in which a slide 13 is guided with little play. The slide 13 is secured by a holding pin 14 which is pressed into a transverse bore 15 of the punch 7. For permitting a displacement, the slide 13 has an axially extending oblong hole 16 whose ends 17, 18 form the stops on the holding pin 14. On the rearward side 19, the slide 13 is supported by a pressure spring 20 or is driven by it toward the sinking. However, the support as well as the drive of the slide 13 can also take place hydraulically, pneumatically or in a mechanical manner by a slider element. In the inoperative position of the punch 7, the slide 13 also rests with its face 35 on the hollow section 5, the end 18 of the oblong hole 16 resting against the holding pin 14. In this stage, a pressure exists in the hollow section 5 which is lower than a pressure which would expand the hollow section 5 toward the outside, such as atmospheric pressure.

Figure 2:
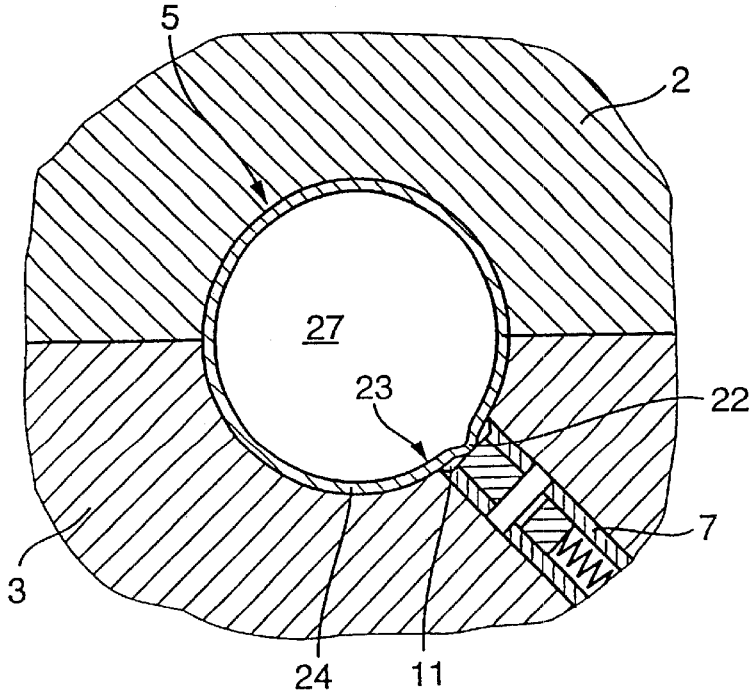
FIG. 2 is a view of the device of FIG. 1 in a condition of the tool acting by means of a forming pressure.

When the pressure is increased to a forming pressure of approximately 2,000 bar, the hollow section 5 begins to expand into the trough 11 of the punch 7 which is still in the inoperative position (FIG. 2). In this case, the slide 13 is displaced to its other stop, thus, for resting its oblong hole end 17 on the holding pin 14 against the force of the pressure spring 20 which changes into a prestressed condition. In this case, the slide 13 acts virtually as a counterholder, as known also from the construction of T-pieces by internal high pressure forming. A dent 22 is formed on the hollow section 5, in which case, when the hollow section material flows into the trough 11, this hollow section material is diluted in the edge area 23 of the guide bore 6 at the transition to the sinking 4 by pulling the material over the guide bore edge. In its inoperative position, the face 35 of the slide 13, together with the face 8 of the punch 7, will then form the base of the expansion trough 11.

Figure 3:
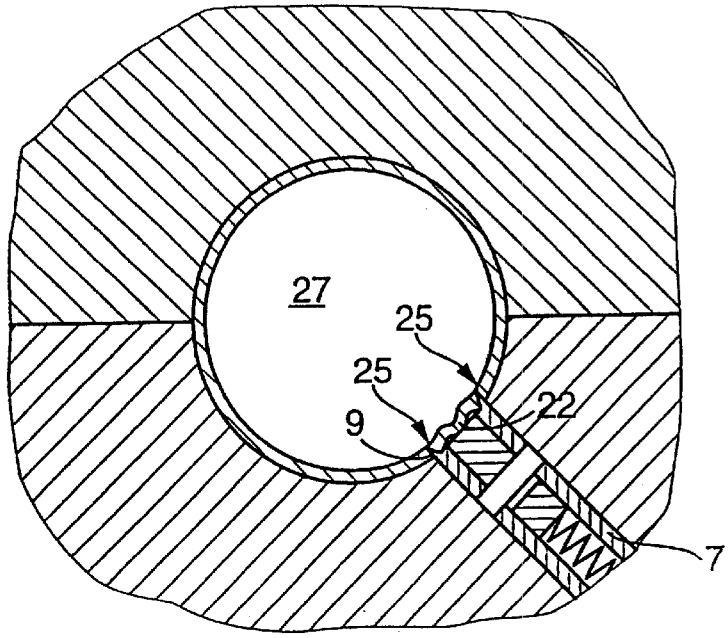
FIG. 3 is a view of the device of FIG. 1 in the operating position of the punch, with the tool acting by means of a forming pressure.

Subsequently, the punch 7 is displaced toward the sinking 4 against the unreduced high internal high pressure by means of a hydraulic system which generates high pressure and acts as a driving device, until the ring blade 9 cuts into the hollow section wall 24 in the form of a piercing. The cutting-in creates a thin area 25 in the hollow section wall 24, at the same time, the dent 22 of the future hole slug 26 being pushed back by the punch movement slightly in the direction of the interior 27 of the hollow section 5 (FIG. 3). The production of the thin area 25 is promoted by the preceding thinning-out of the hollow section material in the edge area 23 by the widening of the hollow section 5, in which case the incision must then take place with a lower penetration depth than the cutting-in without the previous thinning-out. In this case, the ring blade 9 is also slightly protected with respect to its wear.

After the generating of the thin area 25, the punch 7 is abruptly or jerkily withdrawn into the inoperative position, whereupon the thin area 25 will tear in a surrounding manner. The wall thickness of the thin area 25 is dimensioned such or is so unstable that the hole slug 26 can easily be torn out of the hollow section wall 24. Because of the clean cut by means of the ring blade 9, the edge 28 of the produced hole 29 is plane and sharp-edged toward the exterior side 10 of the hollow section 5. The exterior side 20 remains undeformed by the continuous contact pressure of the internal high pressure onto the sinking 4 also in the area of the hole edge 28 so that the shape of the hollow section 5 is maintained after the perforation. By means of the jerky withdrawal of the punch 7, advantageously the inertia of masses of the hole slug 26 still situated in the hollow section wall 24 and of the vacuum occurring for a short time between the exterior side 10 of the hollow section 5 and the punch 7 is utilized for the tearing so that the hole slug 26 is also torn out abruptly—without having any contact with the punch 7—only be the action of the internal high pressure.

Figure 4:
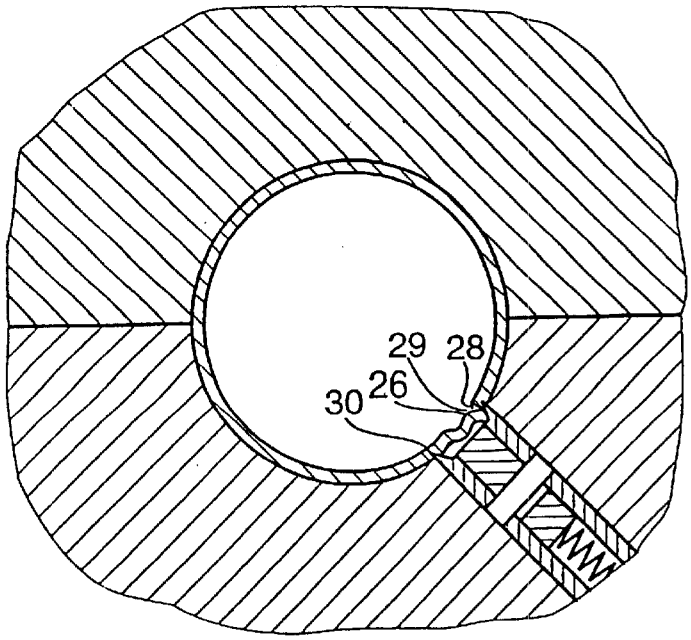
FIG. 4 is a view of the device of FIG. 1 after the machining of the hollow section.

When several holes 29 are created by the extracting of hole slugs 26 from the inside to the outside, the known problem generally occurs that, during the extraction of a first hole slug 26, because a complete sealing with respect to the high pressure cannot be achieved toward the outside, a strong pressure drop will occur, whereupon the subsequent holes cannot be produced or can be produced only insufficiently with inaccurately dimensioned hole measurements and deformations of the hollow section 5 in the hole edge area in the manner of plastic indentations. This will occur particularly when the holes 29 to be produced have a cross-sectional surface of different sizes, in which case the hole 29 with the comparatively largest cross-sectional surface will form as the first one because of the shearing force of the internal high pressure applied to the hollow section wall 24. In order to avoid this or at least reduce the consequences which are damaging to a further dimensionally accurate production of holes in the internal high pressure forming tool 1, according to the invention, advantageously, the penetration depth of the punch 7 by its ring blade 9 into the hollow section wall is determined individually for each hole 29 to be produced so that, for the production, after the penetration of the punch 7, a thin area 25 is created which is coordinated with the cross-sectional surface of the concerned hole 29. For producing a hole 29 of a smaller cross-sectional surface, the wall 24 of the hollow section 5 is weakened more than for producing a hole 29 of a larger cross-sectional surface. The determination or the coordination is such that the holes 29 are created virtually simultaneously. If, in the case of certain holes 29, the extraction of the hole slugs 26 has not been completed, these will at most still hang on a thin wall thread 30 (FIG. 4) which later can be cut off after the removal of the perforated hollow section 5 from the forming tool 1. The ridge which may form in this case is of secondary importance for the manufacturing quality of the hollow section 5 since, because of the preceding incision by the ring blade 9 of the punch 7, the ridge is not situated in the area of the exterior side 10 of the hollow section 5. Because of the process according to the invention, the most varied hole geometries can be formed in a simple manner, in which case only the punch 7 must have a corresponding construction on its face 8 and its guide bore 6.

In the inoperative position, the punch 7 can be arranged such in the guide bore 6 that the hole slug 26 separated out of the hollow section wall 24 can leave the hollow section 5 only partially. In this case, the hole slug 26 is still in the hole 29 at approximately 3/10–5/10 of the wall thickness of the hollow section wall 24. The separating operation of the hole slug 26 from the hollow section wall 24 is therefore concluded. Then, the internal high pressure within the hollow section interior 27 is preferably lowered to atmospheric pressure, after which the slide 13 is moved onto the hole slug 26. This hole slug 26 is pushed by the slide 13 completely back into the hole 29 which avoids a projection of the hole slug 26 over the exterior side 10 of the hollow section 5. Because of the rebounding of the material of the perforated hollow section 5 on the hole edge 28, it is always ensured that the hole slug 26 is clamped in the hole 29.

The forming tool 1 is then opened at atmospheric pressure, after which the hollow section 5 can be removed from it. After the removal of the hollow section, the hole slug 26 can now be pressed out of the hollow section 5 by means of a simple device in a conventional manner without the occurrence of deformations of the hollow section 5 in the area of the hole edge 28. The pressing-out can take place, for example, during the testing operation of the quality control test, in which case markers are arranged which can be displaced in a device which can be pushed into the hollow section 5, which markers, for checking the perforations, are pressed out through the holes 29 together with the hole slugs 26. In the case of bent hollow sections 5, into which the sliding of such devices cannot be carried out, it is conceivable to press the hole slugs 26 after the removal of the hollow section into the hollow section interior 27 and then to remove these hole slugs 26 from this interior by rinsing by means of a liquid. As a result of this arrangement of the punch 7 and the push-back function of the slide 13 for the hole slug 26, it can be advantageously avoided that this slug must be removed from the forming tool 1 at high expenditures. This is important for a disturbance-free economical automation of the manufacturing of perforated hollow sections.

Naturally, it is also conceivable that the hole slug 26 is torn completely out of the hollow section wall 24 and that then the hole slug 26 is pushed by the slide 13 back into the hole 29. However, this is difficult because of the smaller cross-section of the hole 29 because of the rebounding of material in the area of the hole edge 28 in comparison to the cross-section of the extracted hole slug 26.

Figure 5:
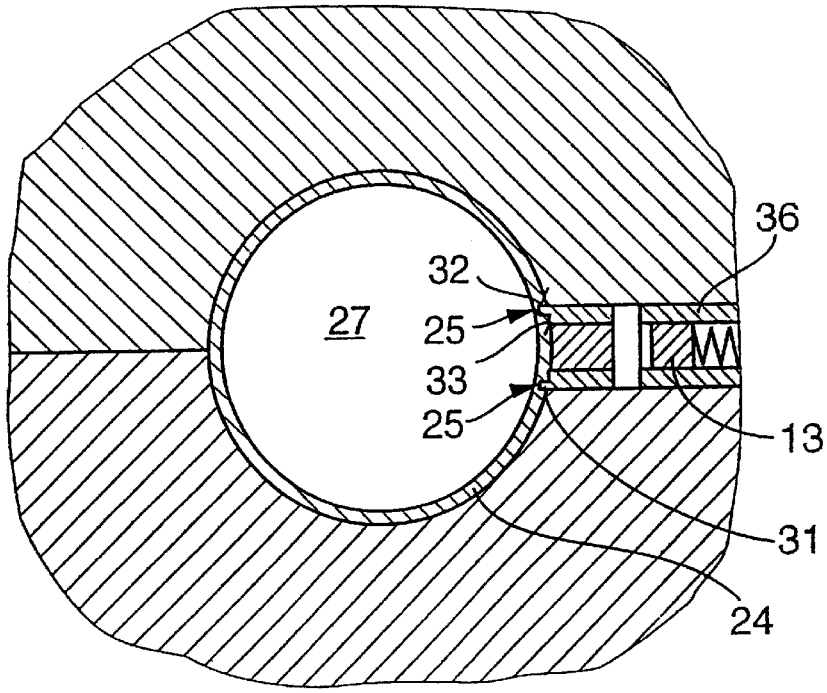
FIG. 5 is a cross-sectional view of the device according to the invention with a hollow section inserted in the sinking of the internal high pressure forming tool and a punch provided with a ring-shaped stampable wall, in the operative position of the punch in the pressure-admitting condition of the tool.

As an alternative to producing the thin area 25 according to FIGS. 1 to 4 by means of the ring blade 9, a stamping punch 36 can be used which, on its face 8, has, instead of the ring blade 9, as the penetration device, a ring-shaped wall 31 which has a rectangular cross-section and, by means of its exterior side 32, closes off flush with the punch circumference as illustrated in FIG. 5. In this case, the punch 36 is already in the operative position, in which case—driven by a high-pressure-generating hydraulic system—it has penetrated in the hollow section wall 24 by means of the ring-shaped wall 31 and because of the stamping generated a weakening of the wall which forms the thin area 25 and has a surrounding shape corresponding to the shape of the wall 32.

In contrast to the preceding embodiment in which the hollow section wall 24 is separated by the piercing by means of the ring blade 9 while forming a cut, during the stamping, hollow section material of the hollow section wall 24 is displaced. The displaced hollow section material flows into a trough 12 which is formed in the face 8 of the punch 36 and which is bounded by the ring-shaped wall 31. In contrast to trough 11, trough 33 is completely filled by flowing hollow sectional material. This achieved flow of material into a trough 33 provided for this purpose permits the construction of the desired thin area 25. This is not possible by means of a plane plate-shaped construction of the punch face 8 which is known from the type-forming document.

Figure 6:
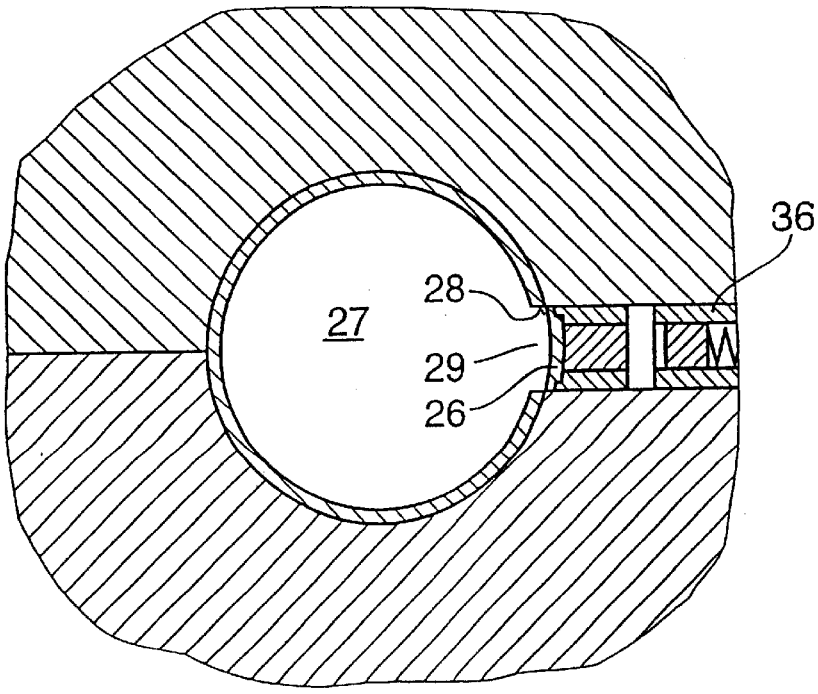
FIG. 6 is a view of the device of FIG. 5 in the inoperative position of the punch after the machining of the hollow section.
Figure 7:
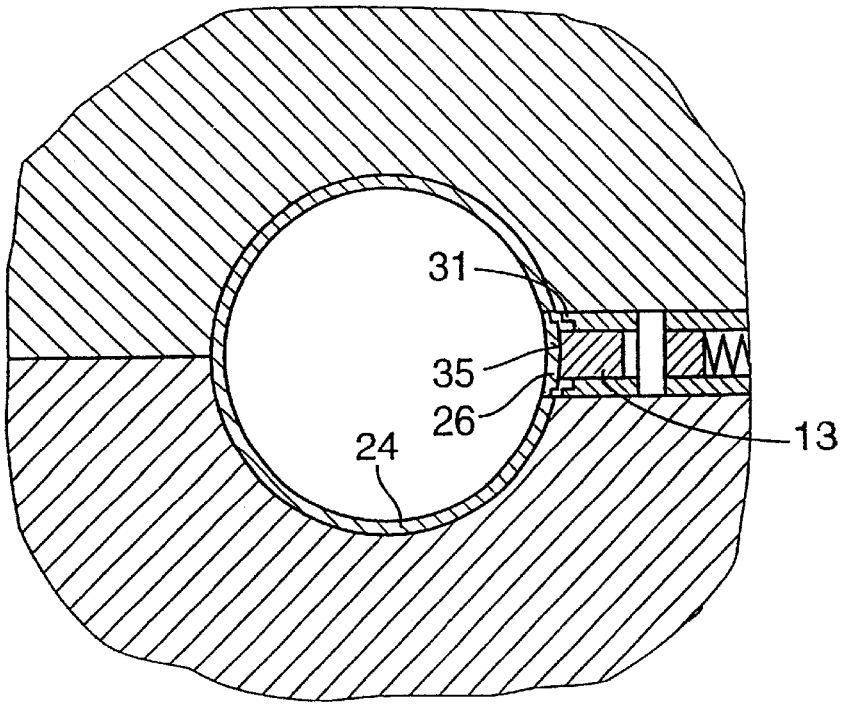
FIG. 7 is a view of the device of FIG. 5 in the inoperative position of the punch after the machining of the hollow section during the clamping of the hole slug in the hole in the pressureless condition of the tool.
Figure 8:
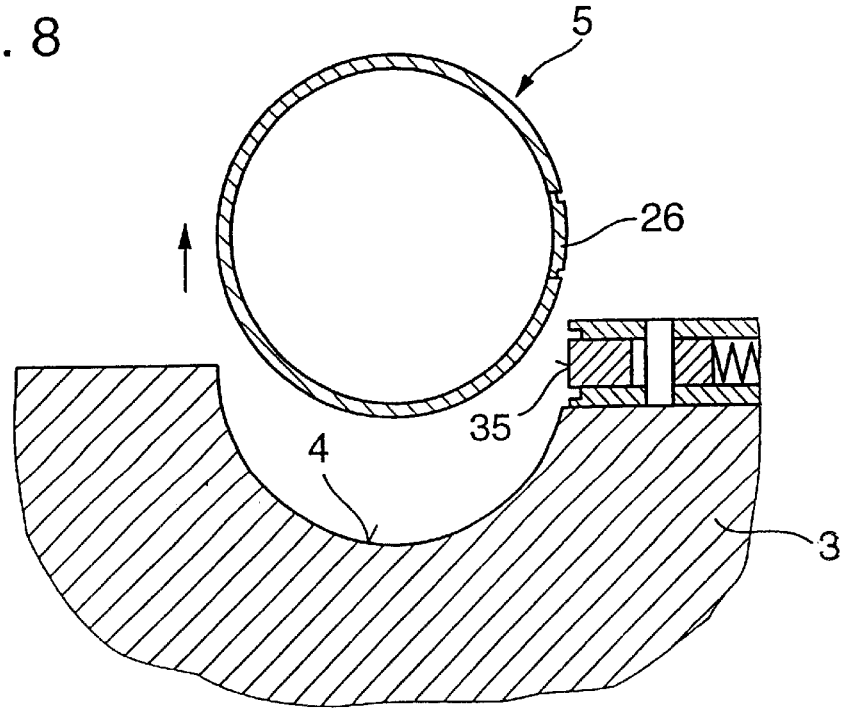
FIG. 8 is a view of the device of FIG. 5 in the opened condition of the tool during the removal of the completely machined section.

In correspondence with the first embodiment, during the stamping of the thin area 25, a high pressure in the range of approximately 2,000 bar acts in the interior of the hollow section 5. Also at this pressure, a widening of the hollow section 5 takes place before the stamping, which hollow section 5 widens in this case into the trough 33. After the stamping, the punch 36 is withdrawn in the same manner, upon which the thin area 25 tears in a surrounding manner (FIG. 6). Preferably at atmospheric pressure, the slide 13 presses the produced hole slug 26 back into the hole 29 (FIG. 7). After the clamping of the hole slug 26 in the hole 29, the pressure in the interior 27 of the hollow section 5 is completely relaxed and the forming tool 1 is then opened. The opening takes place in this case by the lifting of the top tool 2, after which the machined hollow section 5 can be removed. In this case, the perforation axis extends in the plane of division 21 of the top and the bottom tool 2, 3 (FIG. 8). The statements made with respect to the first embodiment apply in a corresponding manner to the producing of several holes 29.

The producing of the holes 29 can take place in the case of hollow sections 5 which were produced in other tools as well as in the case of hollow sections 5 which were first produced by internal high pressure forming from a hollow blank inserted in the forming tool 1 and are subsequently calibrated. The hollow section 5 may consist of assembled, preferably welded half shells or of extruded sections.

In addition, the holes 29 may also be produced in that, after being inserted into the forming tool 1, the hollow section is expanded by internal high pressure and the expanding hollow section 5 acts upon a punch 7, or 36 which projects into the sinking 4 of the forming tool 1 and is supported on the rearward side, whereby the thin area 25 of the hollow section wall 24 is formed. After the concluded widening, the punch 7, 36 is withdrawn, after which the thin area 25 tears under the effect of the internal high pressure and the resulting hole slug 26 is torn to the outside.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Process for manufacturing holes on the circumference of a hollow section situated in an internal high pressure forming tool, by the action of a punch integrated in the forming tool, a desired breaking area being formed on the hollow section which follows the edge contour of an acting face of the punch, and after the withdrawal of the punch, the hollow section material surrounded by the desired breaking area, acted upon by internal high pressure, being extracted from the hollow section from the inside to the outside while forming a hole, wherein, by penetration of the punch into a wall of the hollow section at an internal high pressure, which corresponds to a forming pressure for forming a hollow blank inserted in the forming tool, the wall of the hollow section is weakened by forming an unstable thin area which provides the desired breaking point; and, during withdrawal of the punch the internal high pressure, the hollow section material surrounded by the thin area is torn out of the hollow section in the withdrawal direction of the punch, whereby the hole is generated.

2. Process according to claim 1, wherein, for producing a hole of a relatively smaller cross-sectional surface, the wall of the hollow section is weakened more than for producing a hole of a relatively larger cross-sectional surface.

3. Process according to claim 1, wherein the hollow section material acted upon by the punch is displaced into a trough on a face of the punch.

4. Process according to claim 3, wherein the wall is weakened by stamping the punch into the hollow section wall.

5. Process according to claim 3, wherein the wall is weakened by piercing of a punch provided with a ring blade into the hollow section material.

6. Process according to claim 1, wherein, before being acted upon by the punch the hollow section is widened by means of internal high pressure into an expansion trough worked into the face of the punch, and hollow section material is displaced from the area of the desired breaking point to be formed into the expansion trough.

7. Process according to claim 1, wherein:

first by means of the internal high pressure deforming, the hollow section is produced from a hollow blank inserted into the forming tool and is then calibrated; and subsequently the holes are produced in the same forming tool.

8. Process according to claim 1, wherein after the abrupt withdrawal of the punch, the hollow section material surrounded by the thin area is torn out of the hollow section wall.

9. Process according to claim 1, wherein:

the hollow section is expanded by internal high pressure; and the thin area of the hollow section wall is formed in that the expanding hollow section acts upon a punch projecting into the sinking of the forming tool.

10. Device for producing holes on the circumference of hollow sections, having an internal high pressure forming tool in whose sinking the hollow section is accommodated for producing the respective hole, and having a punch which is displaceable by driving devices and is accommodated in a guide bore starting out from the sinking of the forming tool, the punch projecting in an operative position with the face directed toward the sinking out of the guide bore and acting upon the hollow section for forming a desired breaking point following an edge contour of the punch, and in an inoperative position, being arranged to be completely withdrawn in the guide bore, wherein:

on the face of the punch facing the hollow section, in the edge area, a penetration device is arranged which projects from this face, by means of which penetration device a desired breaking area can be produced which weakens the wall of the hollow section; and by means of a driving device, the punch is supported in the operative position against an internal high pressure corresponding to a forming pressure for forming a hollow blank inserted in the forming tool generated in the hollow section, in this operative position, the penetration depth of the penetration device in the wall of the hollow section being dimensioned such that an unstable thin area is created in the hollow section wall which forms the desired breaking point and which, when the punch is withdrawn, tears on all sides solely by the action of the internal high pressure.

11. Device according to claim 10, wherein the penetration device is a ring-shaped wall which has a rectangular cross-section and, by means of its exterior side ends flush with the punch circumference.

12. Device according to claim 10, wherein the penetration device is a ring blade whose exterior side is aligned with the punch circumference.

13. Device according to claim 10, wherein the punch has a trough on its face which is bounded by the penetration device.

14. Device according to claim 10, wherein the driving device is a high-pressure-generating hydraulic system.

15. Device according to claim 10, wherein the punch has an axial bore in which a slide is guided by means of which the material which was torn out of the hollow section wall and forms a hole slug, can be pressed out of the guide bore of the punch.

16. Device according to claim 15, wherein the face of the slide opposite the hollow section, in its inoperative position, forms a base of an expansion trough in the face of the punch.

17. Device according to claim 15, wherein the slide can be displaced until it rests against the hollow section.

* * * * *